US009941584B2

(12) United States Patent
Kona et al.

(10) Patent No.: US 9,941,584 B2
(45) Date of Patent: Apr. 10, 2018

(54) REDUCING ANTENNA ARRAY FEED MODULES THROUGH CONTROLLED MUTUAL COUPLING OF A PIXELATED EM SURFACE

(71) Applicant: HRL LABORATORIES LLC., Malibu, CA (US)

(72) Inventors: Keerti S. Kona, Woodland Hills, CA (US); James H. Schaffner, Chatsworth, CA (US); Hyok J. Song, Oak Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 14/621,907

(22) Filed: Feb. 13, 2015

(65) Prior Publication Data

US 2015/0236408 A1 Aug. 20, 2015

Related U.S. Application Data

(60) Provisional application No. 61/940,070, filed on Feb. 14, 2014.

(51) Int. Cl.

| | |
|---|---|
| ***H01Q 1/52*** | (2006.01) |
| ***H01Q 3/26*** | (2006.01) |
| ***H01Q 21/06*** | (2006.01) |
| ***H01Q 21/22*** | (2006.01) |

(52) U.S. Cl.

CPC ..... *H01Q 1/523* (2013.01); *H01Q 3/26* (2013.01); *H01Q 21/065* (2013.01); *H01Q 21/22* (2013.01)

(58) Field of Classification Search

CPC ..... H01Q 3/26; H01Q 1/523; H01Q 21/065; H01Q 19/005

See application file for complete search history.

(56) References Cited

U.S. PATENT DOCUMENTS

| | | | | |
|---|---|---|---|---|
| 5,105,200 A * | 4/1992 | Koepf | H01Q 1/364 333/101 |
| 5,619,365 A | 4/1997 | Rhoads et al. | |
| 5,923,291 A | 7/1999 | Page | |
| 6,005,519 A * | 12/1999 | Burns | H01Q 1/38 343/700 MS |
| 6,078,288 A | 6/2000 | Adams et al. | |
| 6,198,438 B1 * | 3/2001 | Herd | H01Q 3/247 343/700 MS |

(Continued)

FOREIGN PATENT DOCUMENTS

CN 102820540 A 12/2012

OTHER PUBLICATIONS

International Search Report and Written Opinion (ISR & WO) from PCT Application No. PCT/US2015/015070, dated Nov. 19, 2015.

(Continued)

*Primary Examiner* — Daniel J Munoz
(74) *Attorney, Agent, or Firm* — Ladas & Parry

(57) ABSTRACT

A reconfigurable radio frequency aperture including a substrate, a plurality of reconfigurable patches on the substrate, and a plurality of reconfigurable coupling elements on the substrate, wherein at least one reconfigurable coupling element is coupled between a reconfigurable patch and another reconfigurable patch, and wherein the reconfigurable coupling elements affect the mutual coupling between reconfigurable patches.

26 Claims, 10 Drawing Sheets

(56) References Cited

U.S. PATENT DOCUMENTS

| | | | | |
|---|---|---|---|---|
| 6,218,990 | B1 | 4/2001 | Grangeat et al. | |
| 6,388,631 | B1 * | 5/2002 | Livingston | H01Q 3/24 342/374 |
| 7,068,234 | B2 * | 6/2006 | Sievenpiper | H01Q 3/26 343/745 |
| 7,965,249 | B1 | 6/2011 | Wolf et al. | |
| 8,009,115 | B2 | 8/2011 | Walton et al. | |
| 2002/0003497 | A1 | 1/2002 | Gilbert et al. | |
| 2002/0101391 | A1 | 8/2002 | Kanamaluru et al. | |
| 2003/0036750 | A1 | 2/2003 | Ruiz et al. | |
| 2004/0263420 | A1 | 12/2004 | Werner et al. | |
| 2005/0237237 | A1 | 10/2005 | Lust et al. | |
| 2005/0237267 | A1 | 10/2005 | Brown et al. | |
| 2007/0180338 | A1 | 8/2007 | Becker et al. | |
| 2008/0029753 | A1 | 2/2008 | Xu et al. | |
| 2008/0297194 | A1 | 12/2008 | Zeng et al. | |
| 2009/0309799 | A1 * | 12/2009 | Hossain | H01Q 3/44 343/754 |
| 2011/0095958 | A1 * | 4/2011 | Mao | H01Q 1/523 343/860 |
| 2012/0162010 | A1 | 6/2012 | Georgiadis et al. | |
| 2013/0176177 | A1 * | 7/2013 | Cetiner | H01Q 19/005 343/700 MS |
| 2016/0013549 | A1 | 1/2016 | Schaffner et al. | |

OTHER PUBLICATIONS

U.S. Appl. No. 14/617,361, filed Feb. 9, 2015, Schaffner et al.
Chua et al., "Low Resistance, High Dynamic Range Reconfigurable Phase Change Switch for RF Applications", Applied Physics Letters, vol. 97, 183506, 2010.
Lo et al., "Three-Terminal Probe Reconfigurable Phase-Change Material Switches", IEEE Transactions on Electron Devices, vol. 57, No. 1, pp. 312-320, Jan. 2010.
Wen et al. "A Phase-Change-Via-Reconfigurable On-Chip Inductor", IEDM Tech Digest, pp. 10-237-10-240, 2010.
EE Times, Nov. 2011, "Samsung Preps 8-Gbit Phase-Change Memory".
Perniola et al. "Electrical Behavior of Phase-Change Memory Cells Based on GeTe", IEEE Electron Device Letters, vol. 31, No. 5, May 2010, pp. 488-490.
Li et al., "A New Class of Antenna Array With a Reconfigurable Element Factor", IEEE Transactions on Antennas and Propagation, vol. 61, No. 4, Apr. 2013, pp. 1947-1955.
Rodrigo et al., "Frequency and Radiation Pattern Reconfigurability of a Multi-Size Pixel Antenna", IEEE Transactions on Antennas and Propagation, vol. 60, No. 5, May 2012, pp. 2219-2225.
Besoli et al., "A Multifunctional Reconfigurable Pixelated Antenna Using MEMS Technology on Printed Circuit Board", Vo. 59, No. 12, Dec. 2011, pp. 4413-4424.
Su et al., A Numerically Efficient Transmission Characteristics Analysis of Finite Planar Frequency-Selective Surfaces Embedded in Stratified Medium, ICMMT 2010 Proceedings, pp. 152-155.
Phillips Media Relations, DVD+Rewritable—"How It Works", 1999, Eindhoven, The Netherlands.
D.J. Adelerhol et al., "Media Development for DVD+RW Phase Change Recording", Proc. European Symposium on Phase Change Material (epcos.org), 2004.
J.F. Seurin et al., "High Power VCSELs Mature Into Production", Laser Focus World, Apr. 2011, pp. 61-65.
J.K. Olsen et al., Optical Properties of Amorphous GeTe, SB 2 Te 3, and Ge 2 Te 5: The Role of Oxygen, Journal of Applied Physics, vol. 99, 103508, 2006.
Chu et al., Laser-Induced Phase Transitions of Ge2Sb2Te5 Thin Films Used in Optical and Electronic Data Storage and in Thermal Lithography, Optics Express, vol. 18, No. 17, Aug. 16, 2010, pp. 18383-18393.
M. Xu et al., "Pressure Tunes Electrical Resistivity by Four Orders of Magnitude in Amorphous Ge2Sb2Te5 Phase-Change Memory Alloy", Proceeding National Academy Science U.S.A, May 1, 2012, 109(18), pp. E1055-E1062.
J. Luther, S. Ebadi, and X. Gong in "A Microstrip Patch Electronically Steerable Parasitic Array Radiator (ESPAR) Antenna with Reactance-Tuned Coupling and Maintained Resonance" IEEE Trans. Antenna Propag., vol. 60, No. 4, Apr. 2012, pp. 1803-1813.
P. W. Hannan, D. S. Lerner, and G. H. Knittel in "Impedance Matching a Phased-array Antenna over Wide Scan Angles by Connecting Circuits", IEEE Trans. Antenna Propag., vol. AP-13, Jan. 1965, pp. 28-34.
From U.S. Appl. No. 13/737,441 (now U.S. Pat. No. 8,900,930) Notice of Allowance dated Jul. 31, 2014.
From U.S. Appl. No. 13/737,441 (now U.S. Pat. No. 8,900,930) Non-Final Office Action dated Jun. 4, 2014.
From U.S. Appl. No. 13/737,441 (now U.S. Pat. No. 8,900,930) Restriction Requirement dated Mar. 26, 2014.
From U.S. Appl. No. 14/617,361 (unpublished,), Application and Office Actions.
From PCT Application No. PCT/US2015/015070, Chapter II, International Preliminary Report on Patentability (IPRP), dated Apr. 22, 2016.
From U.S. Appl. No. 14/617,361 (Now published as 2016/0013549), Non-Final Rejection dated Apr. 18, 2016.
International Search Report and Written Opinion (ISR & WO) from PCT/US2015/015966 dated Dec. 9, 2015.
Final Office Action dated Sep. 29, 2016 for U.S. Appl. No. 14/617,361 (Now US publication No. 2016-0013549.).
From PCT Application No. PCT/US2015/015966, Chapter II, International Preliminary Report on Patentability (IPRP), dated Aug. 22, 2016.
2nd Written Opinion from PCT/US2015/015966 dated May 11, 2016.
From U.S. Appl. No. 14/617,361 (now U.S. Publication No. 2016-0013549 A1) Non-final Office Action dated Jan. 6, 2017.
From U.S. Appl. No. 14/617,361 (now U.S. Publication No. 2016-0013549 A1) Final Office Action dated Jun. 22, 2017.

* cited by examiner

REDUCING ANTENNA ARRAY FEED MODULES THROUGH CONTROLLED MUTUAL COUPLING OF A PIXELATED EM SURFACE

CROSS REFERENCE TO RELATED APPLICATIONS

This application is related to and claims the benefit of U.S. Provisional Patent Application Ser. No. 61/940,070, filed Feb. 14, 2014, and is related to U.S. patent application Ser. No. 14/617,361, filed Feb. 9, 2015, and U.S. patent application Ser. No. 13/737,441, filed Jan. 9, 2013, which are incorporated herein as though set forth in full.

TECHNICAL FIELD

This disclosure relates to antennas and in particular to active phased array antenna and radio frequency apertures.

BACKGROUND

Reconfigurability of a radio frequency (RF) aperture, such as a phased array antenna, is a highly desirable feature so that the radiation characteristics can be changed by modifying the physical and electrical configuration of the array to provide a desired performance metric, such as a desired frequency, scan angle, or impedance.

Prior art phased arrays typically use transmit/receive (TR) modules with phase shifters, amplifiers in each radiation element. A spacing of TR modules that is close to $\lambda/2$ or less than $\lambda/2$ is generally used to prevent grating lobes, where $\lambda$ is the wavelength of the center frequency of a transmitted or received signal. A $\lambda/2$ or less spacing between the TR modules together with the size or aperture of the phased array antenna determines the number of TR modules required in the phased array antenna. For a given size or aperture of a phased array antenna, it is desirable to have fewer TR modules, because the number of TR modules drives the cost of the phased array antenna.

It is also desirable to be able to reconfigure phased array antenna to achieve different beam patterns. In the prior art this requires reconfiguring the RF feed to the TR modules, and therefore these prior art phased arrays have quite limited reconfigurability.

In the prior art, J. Luther, S. Ebadi, and X. Gong in "A Microstrip Patch Electronically Steerable Parasitic Array Radiator (ESPAR) Antenna with Reactance-Tuned Coupling and Maintained Resonance" *IEEE Trans. Antenna Propag.*, Vol. 60, No. 4, April 2012, pp. 1803-1813 describe using varactors and coupling capacitors between the driven and parasitic patches as means of controlling the coupling for a parasitic phased array. The array elements are fixed and the tuning of the varactors switches the beam. P. W. Hannan, D. S. Lerner, and G. H. Knittel in "Impedance Matching a Phased-array Antenna over Wide Scan Angles by Connecting Circuits", *IEEE Trans. Antenna Propag.*, Vol. AP-13, January 1965, pp. 28-34 describe the use of connecting circuits between transmission lines to improve the scan impedance and scan performance of a phased array. Phase shifters are used for beam-steering, and an array is described made of wideband elements and using lumped element capacitors/inductors for changing the phase of the signals between the radiating elements.

What is needed is an RF aperture and active phased array antenna that has improved reconfigurability, and that can have a fewer number of TR modules. The embodiments of the present disclosure address these and other needs.

SUMMARY

In a first embodiment disclosed herein, a reconfigurable radio frequency aperture comprises a substrate, a plurality of reconfigurable patches on the substrate, and a plurality of reconfigurable coupling elements on the substrate, wherein at least one reconfigurable coupling element is coupled between a reconfigurable patch and another reconfigurable patch, and wherein the reconfigurable coupling elements affect the mutual coupling between reconfigurable patches.

In another embodiment disclosed herein, a reconfigurable radio frequency aperture comprises a plurality of reconfigurable patches on the substrate, and a plurality of reconfigurable parasitic elements on the substrate, wherein at least one reconfigurable parasitic element is between a reconfigurable patch and another reconfigurable patch, wherein at least one reconfigurable coupling element is coupled between a reconfigurable patch and a reconfigurable parasitic element, or between one reconfigurable parasitic element and another reconfigurable parasitic element, and wherein the reconfigurable coupling elements and the reconfigurable parasitic elements affect the mutual coupling between reconfigurable patches a substrate.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 2A:
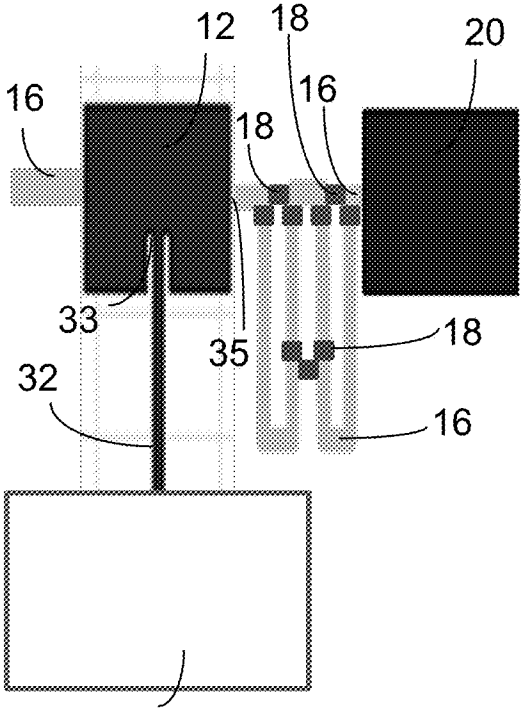
FIG. 2A shows a portion of an RF aperture with coupling elements having phase change material (PCM) switches to provide reconfigurability of the coupling elements.
Figures 2B, 2C:
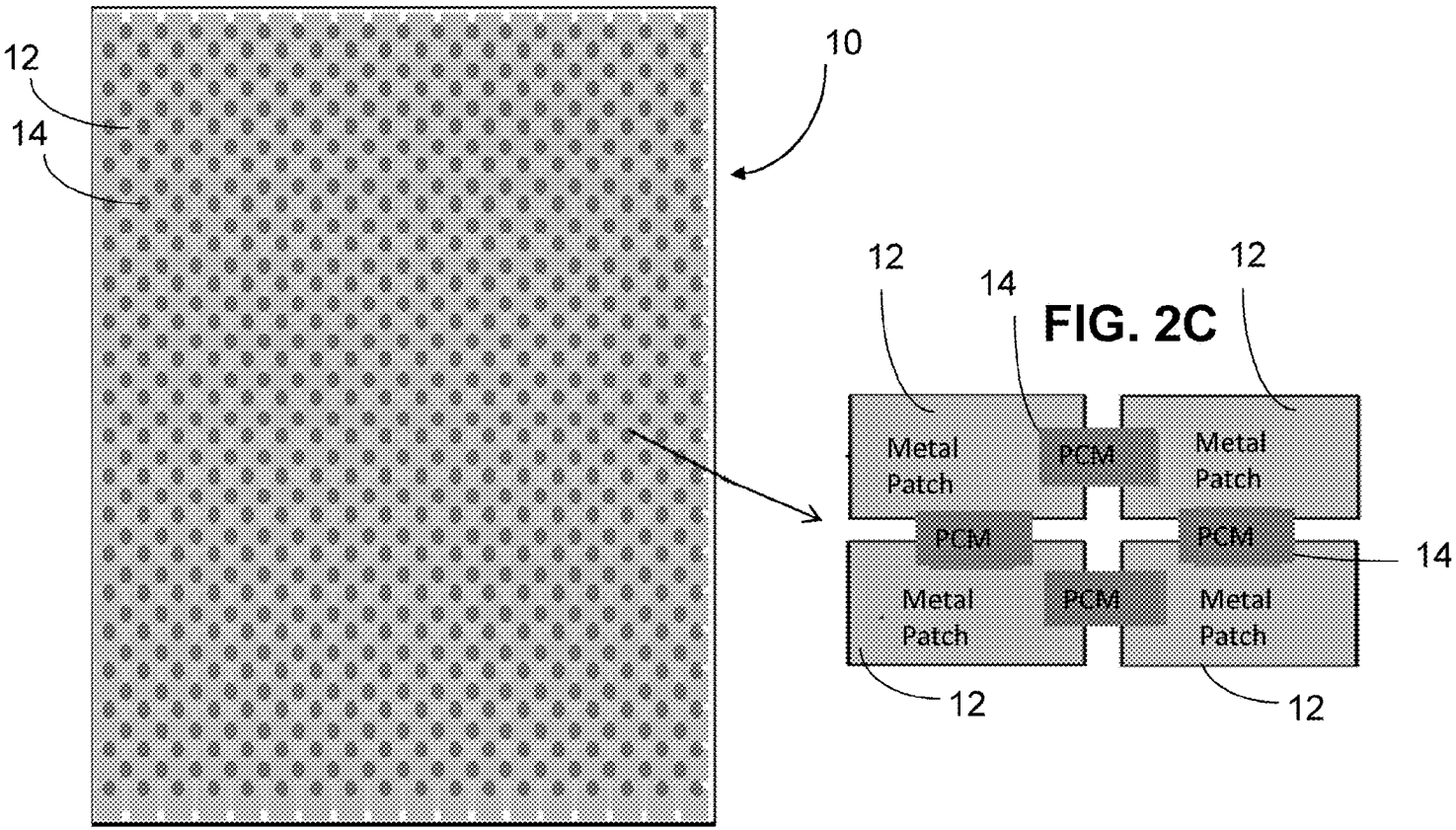
FIGS. 2B and 2C show metal patches with PCM switches between them to provide reconfigurability of patch size in accordance with the present disclosure.

The present disclosure describes an active phased array system with a reduced number of TR feed module that has a pixelated reconfigurable electro-magnetic (EM) surface 10, as shown in FIG. 2B. The pixelated reconfigurable electro-magnetic (EM) surface 10 may be a substrate with reconfigurable patches 12. The sizes of the reconfigurable patches 12 may be changed by connecting adjacent patches with switches 14 as shown in FIG. 2C. The switches 14 may be phase change material that can be switched to an ON conducting state, or to an OFF non-conducting state. To connect adjacent patches 12 the PCM switches are put in an ON conducting state. The patches 12 may be metal patches.

Figure 1:
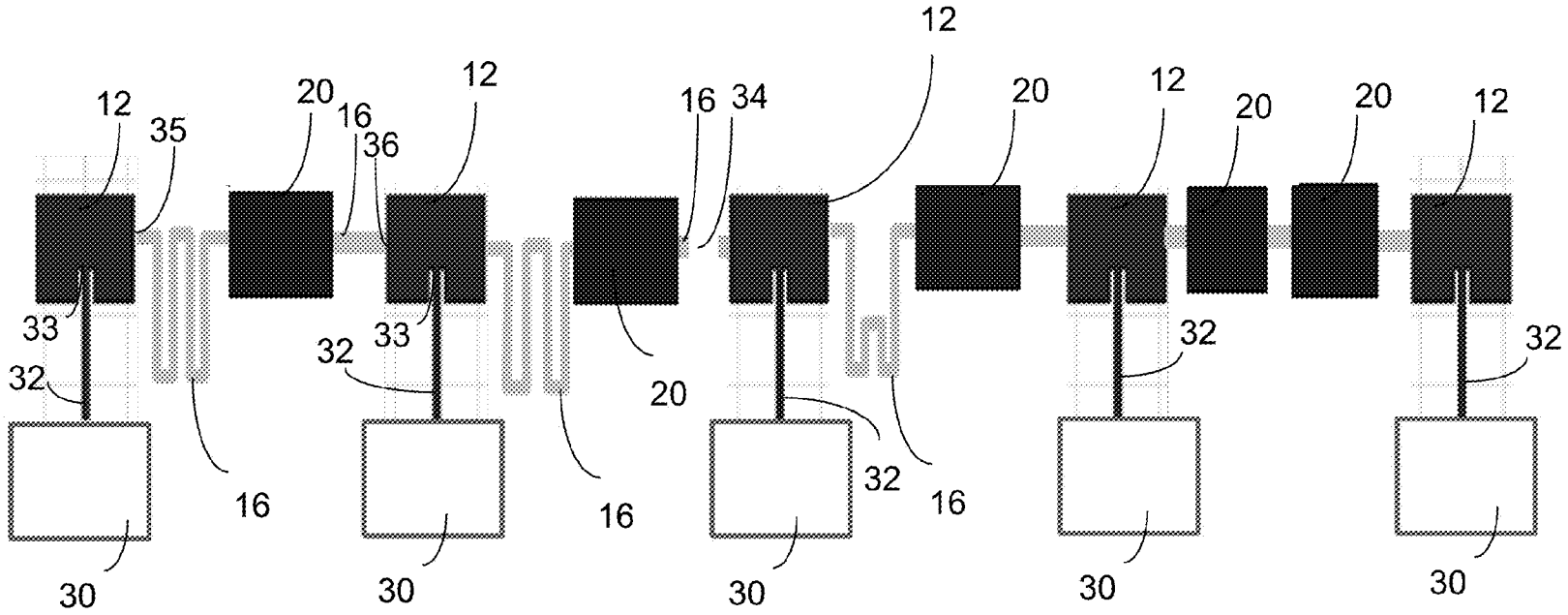
FIG. 1 shows an RF aperture with driven patches spaced $\lambda$ apart with parasitic patches and reconfigurable coupling elements in accordance with the present disclosure.

The pixelated reconfigurable electro-magnetic (EM) surface 10 may also have reconfigurable coupling lines 16, as shown in FIG. 2A. The reconfigurable coupling lines 16 may be metal. The coupling lines 16 may be configured to be in various configurations by switches 18, as shown in FIG. 2A, which may also be a phase change material that can be put in an ON conducting state, or in an OFF non-conducting state. FIG. 1, which is an example detail of one row the pixelated reconfigurable electro-magnetic (EM) surface 10 of FIG. 2B, shows examples of how the coupling lines 16 may be switched into various configurations by turning ON and OFF switches 18. As can be seen in FIG. 1, the coupling lines 16 may be configured to be straight lines or serpentine lines between adjacent patches 12 or parasitic elements 20.

Further, the pixelated reconfigurable electro-magnetic (EM) surface 10 may have reconfigurable parasitic elements 20 that are not driven, for example, by a transmit/receive (TR) module 30. The parasitic elements 20 may be metal and be parasitic patches of various sizes and shapes. The parasitic elements 20 may be reactively loaded by reactive loads 70, as shown in FIG. 7B. The reactive loads 70 may include capacitive and inductive loads. By reconfiguring the size of patches 12, the coupling lines 16, and the size, shape and reactive loading of the parasitic elements 20, a desired performance metric, such as a desired frequency, scan angle, or impedance may be attained.

As discussed above, the pixelated EM surface 10 shown in FIG. 2B is formed by a two dimensional periodic array of metal patches 12 separated by small gaps with 14 switches between gaps that can be activated and deactivated. In addition, as discussed above, the pixelated EM surface has coupling elements 16, and parasitic elements or patches 20, as shown in FIGS. 1 and 2A. The patches 12 may be driven with TR modules 30 for transmit and receive applications.

The array spacing between patches 12 may be greater than $\lambda/2$ at the center frequency. Controlled coupling between patches 12 is achieved by configuring the coupling lines 16 and/or the parasitic patches 20 with the goal being to suppress any grating lobes at large scan angles and also to maintain a low constant voltage standing wave ratio (VSWR) over the scan angle.

As discussed above with reference to FIGS. 2B and 2C, an embodiment of this invention uses phase change (PCM) for the switches 14 in the gaps between the metal patches 12 to change the effective patch sizes. The details of the use of PCM for switches for a reconfigurable EM surface is further described in U.S. patent application Ser. No. 14/617,361, filed Feb. 9, 2015, which is incorporated herein as though set forth in full.

The present disclosure has the following advantages over the prior art: a reduction in the number of TR modules 30 required, and a corresponding reduced number of phase shifter bits for controlling beam steering in a phased array. Conventional phased arrays use a TR module with monolithic microwave integrated circuits (MMICs), which have phase shifters and amplifiers in each radiation element. These MMICs are the largest part of the total antenna cost. A spacing less than $\lambda/2$ is typically used in the prior art to prevent grating lobes, and antenna reconfiguration requires changing the antenna feeds. These factors drive the cost and complexity for a conventional phased array antenna.

In the present disclosure, with reference to FIGS. 1 and 2A, the RF feed lines 32 from the TR modules 30 to the patches 12 are fixed and need not be reconfigured. Patches 12 have dimensions less than the desired wavelength, and parasitic elements 20 and coupling lines 16 are configured on the top surface of the pixelated EM surface 10 to maintain beam scanning and impedance match over a scan angle. The spacing between patches 12 may be greater than $\lambda/2$ at the operating center frequency, which makes it possible to decrease the number of radiating elements and hence the cost. This is accomplished by suppressing the grating wave power and keeping the reflected power to a minimum using controlled coupling provided by the reconfigurable coupling lines 16 and the configurable parasitic patches 20, which suppress grating lobes by changing the mutual coupling between the radiating patches 12.

FIG. 1 shows an RF aperture with metallic patches 12 spaced $\lambda$ apart with feed lines 32 from TR modules 30 to drive the patches 12, and reconfigurable coupling lines 16 between the patches 12 and between parasitic patches 20. As shown in FIGS. 1 and 2A the feed lines 32 are connected to a location 33 on the patches 12. Also as shown in FIGS. 1 and 2A, the reconfigurable coupling lines 16 are connected to a location 35 or 36 on the patches 12. Location 33 on the patches 12 is different than locations 35 and 36 on the patches 12, as shown in FIGS. 1 and 2A. In the embodiment of FIG. 1, which shows a linear array, the reduction in number of TR modules is 50% due to spacing being $\lambda$ between driven patches 12 rather than having a $\lambda/2$ spacing between the driven patches 12. For a two dimensional array, $\lambda$ spacing results in a 4 to 1 reduction in the number of TR modules compared to having a $\lambda/2$ spacing between the driven patches 12. The TR modules 30 and the controlled mutual coupling between each patch 12 can provide beam steering.

FIG. 2A shows a detail of a reconfigurable coupling line 16 between a patch 12 and a passive parasitic patch 20. The reconfigurable coupling line 16 includes PCM switches 18, which provides low resistance connections between portions of the coupling line when the PCM 18 is in an ON state, or separates portions of the coupling line 16 when the PCM 18 is in an OFF state. By switching the PCM switches 18 ON or OFF, many configurations of the coupling lines 16 may be provided. For example, FIG. 1 shows a number of different coupling line 16 configurations. By switching all of the PCM switches 18 in a coupling line 16 to an OFF position, a coupling line 16 between patches may be set to an open position, so that there is no coupling between patches. For example, in FIG. 1 the switches 18 are set so that a break 34 or open 34 is in one of the coupling lines 16, so that there is no connection between the adjacent patch 12 and parasitic patch 20.

FIG. 2B and FIG. 2C which is a detail of FIG. 2B, show an RF aperture 10 with a pixelated array of metallic patches 12 with phase change material (PCM) switches 14 between the metallic patches 12. The PCM material 14 lies in the gaps between the metallic patches 12 such that when actuated into an ON state, the PCM switch provides a low resistance bridge between two patches 12, thus effectively connecting them electrically and therefore changing the effective size of the patch 12. The same method of changing the effective size of a patch 12 may also be used to change the effective size and shape of parasitic patches 20, such as for example parasitic patches 20 shown in FIGS. 1 and 4A. PCM material 14 may be placed in gaps between smaller parasitic patches 20 and switched on and off to change the size of the parasitic patches 20 in the same manner as shown in FIGS. 2B and 2C for patches 12.

The PCM switches 14 and 18 may have an insertion loss of about 0.1 dB and an on-state resistance ($R_{on}$) of less than 0.5Ω. The $R_{off}/R_{on}$ ratio for the PCM switch may be greater than or equal to $10^4$, which provides an RF isolation that is greater than 25 dB. Actuation of particular patterns of PCM switches 14 and 18 may be used to reconfigure the metallic patches 12 and coupling lines 16 on the top surface of the RF aperture 10.

Figure 3A:
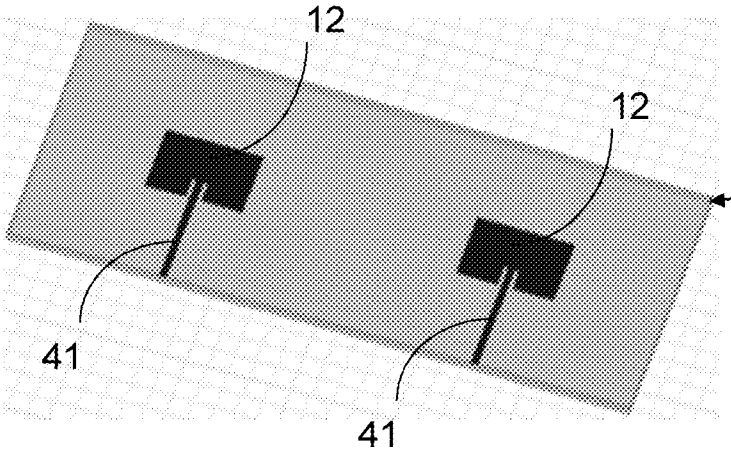
FIG. 3A PRIOR ART
FIG. 3A shows an RF aperture with patches spaced $\lambda$ apart.
Figure 3B:
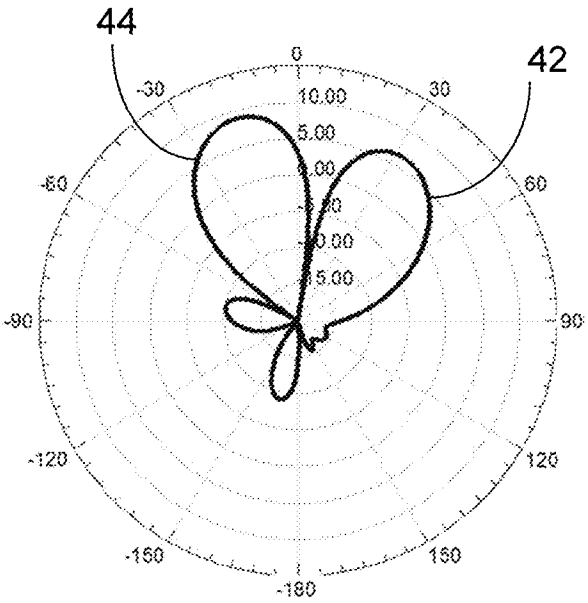
FIG. 3B PRIOR ART
FIG. 3B shows a plot of the scanned radiation pattern where the main beam is scanned to 30° in accordance with the prior art.

FIG. 3A shows a prior art two element metallic patch 40 array with a $\lambda_0$, the wavelength of center frequency $f_0$, spacing of 150 mm at 2 GHz, rather than a $\lambda_0/2$ spacing and with a beam scan angle of 30° from the broadside. When the two patches 41 are excited with equal amplitude and uniform progressive phase difference between them, and with the main beam 42 scanned to ~30° from boresight, a grating lobe 44 appears at ~−20°, as shown in FIG. 3B. In general, using a spacing between λ/2 and λ reduces the number of TR elements and hence the cost of a phased array system; however, results in such grating lobes.

Figure 4A:
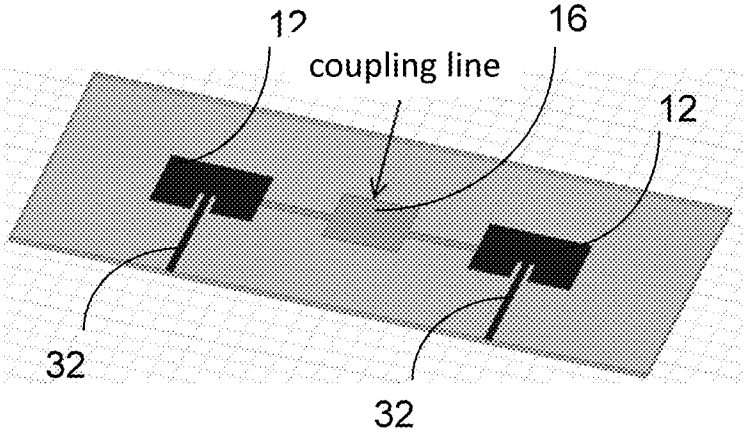
FIG. 4A shows an RF aperture with patches spaced $\lambda$ apart with a coupling element or network between them.
Figure 4B:
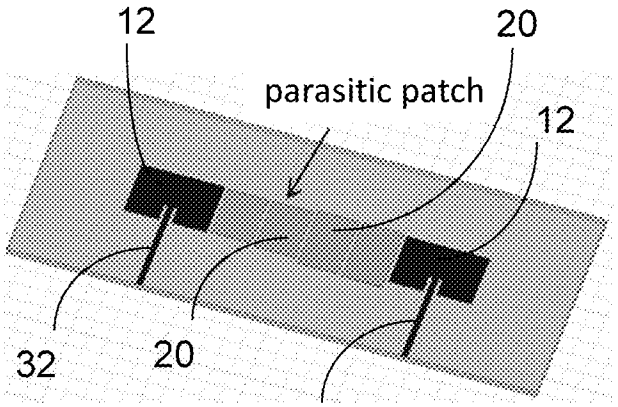
FIG. 4B shows patches spaced $\lambda$ apart with parasitic patches in accordance with the present disclosure.

As discussed above, the patches 12, the reconfigurable coupling lines 16, and the parasitic patches 20 can all be reconfigured. In order to suppress the grating lobes, two methods may be used. The first method, as shown in FIG. 4A, employs reconfigurable coupling lines 16 between two driven patch elements 12. In the second method, as shown in FIG. 4B, parasitic patches 20 between driven patches 12 are used to control the phase between driven patches 12. The parasitic patches may or may not be connected with reconfigurable coupling lines 16 to the driven patches 12. The two methods may also be combined so that the patches 12, the reconfigurable coupling lines 16, and parasitic patches 20 are all reconfigured in order to suppress the grating lobes.

Figure 5A:
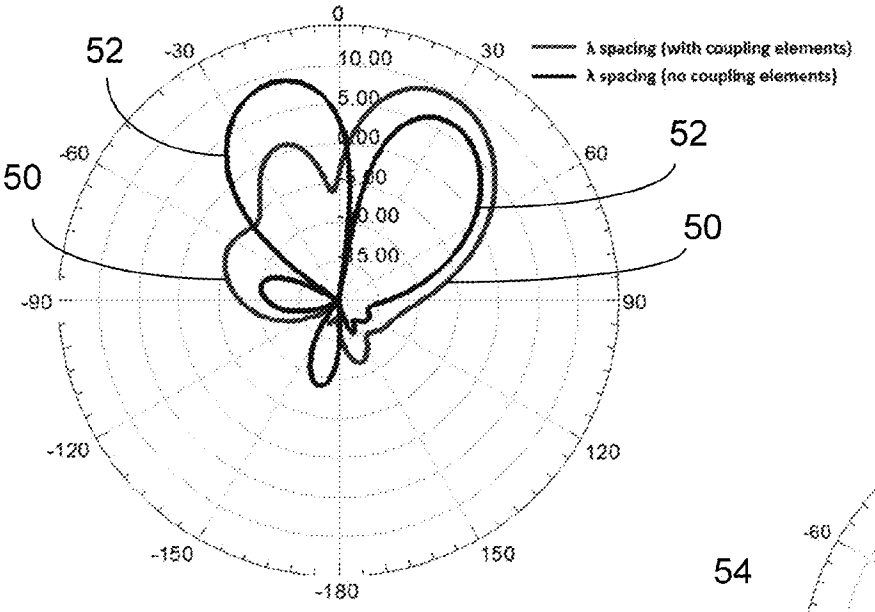
FIGS. 5A and 5B show plots comparing the gain patterns of the configurations shown in FIGS. 4A and 4B, respectively, in accordance with the present disclosure.
Figure 5B:
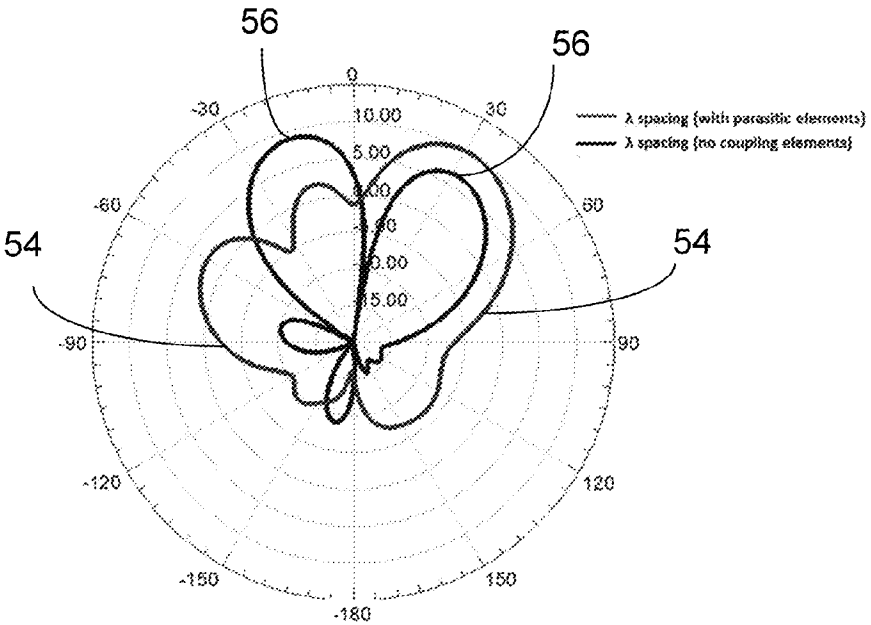
Figure 6A:
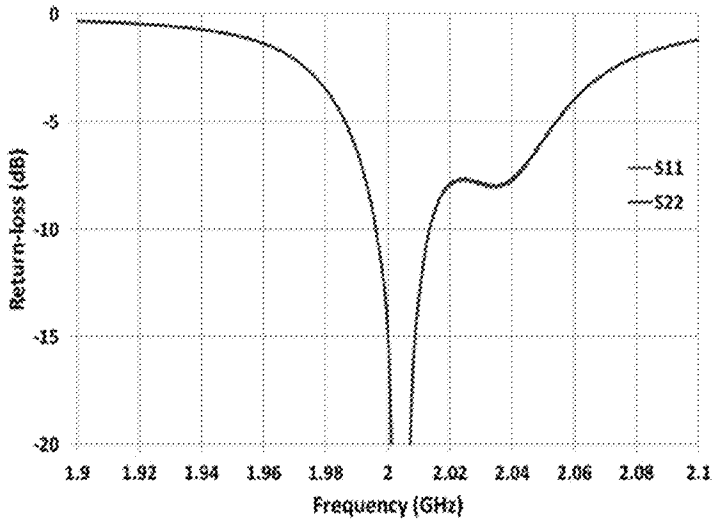
FIGS. 6A and 6B show plots of return-loss for a configuration with driven patches connected with high impedance lines, and driven patches connected with parasitic patches or elements, respectively, in accordance with the present disclosure.
Figure 6B:
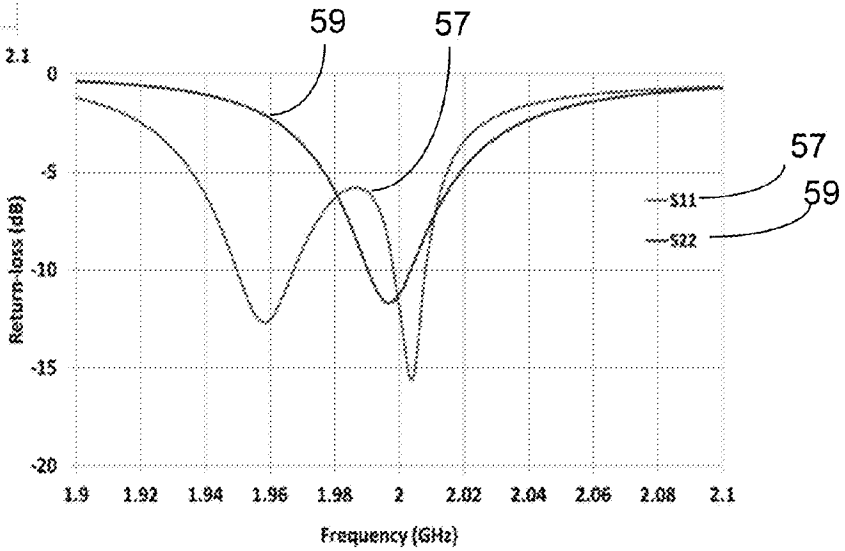

Electromagnetic simulations show that both approaches effectively suppress the grating lobe level of a $\lambda_0$ spaced two element array, as shown in FIGS. 4A and 4B, to be approximately the same as the grating lobe level for a $\lambda_0/2$ spaced array. FIGS. 5A and 5B show beam pattern plots comparing the configurations shown in FIGS. 4A and 4B, respectively. For the configuration of FIG. 4A with coupling lines 16, the plot in FIG. 5A shows that the gain pattern 50 has a grating lobe that is less than the grating lobe of the gain pattern 52 for the same configuration as FIG. 4A without coupling lines 16. For the configuration of FIG. 4B with parasitic patches 20, the plot in FIG. 5B shows that the gain pattern 54 has a grating lobe that is less than the grating lobe of the gain pattern 56 for the same configuration as FIG. 4B without the parasitic patches 20. Full wave electro-magnetic (EM) simulations and multi-objective based optimization may be used for design of the coupling/parasitic elements. Both methods also maintain return-loss/VSWR characteristics of a $\lambda_0/2$ spaced array, as shown in FIGS. 6A and 6B, for the configurations of FIGS. 4A and 4B, respectively, at a center frequency of 2 GHz. S11 and S22 are essentially the same for the configuration of FIG. 4A, as shown in FIG. 6A. For the configuration of FIG. 4B, curve 57 plots S11 and curve 59 plots S22, as shown in FIG. 6B.

Figure 7A:
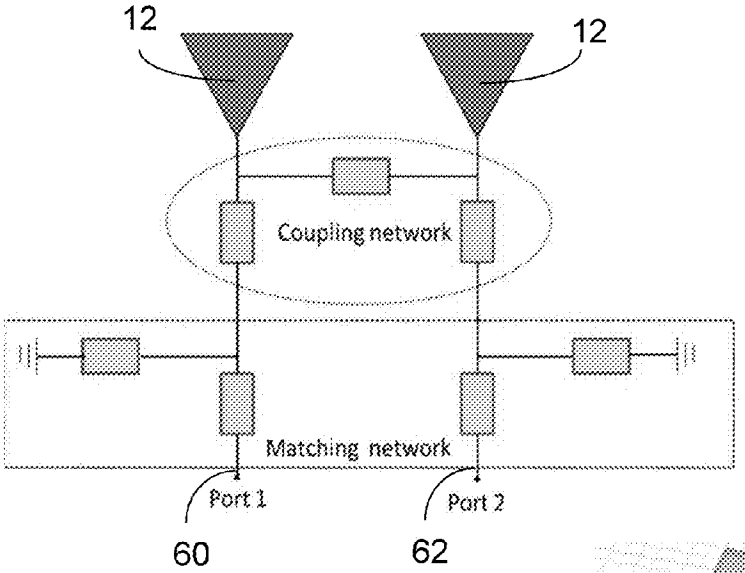
FIG. 7A shows a network representation of a phased array antenna system.
Figure 7B:
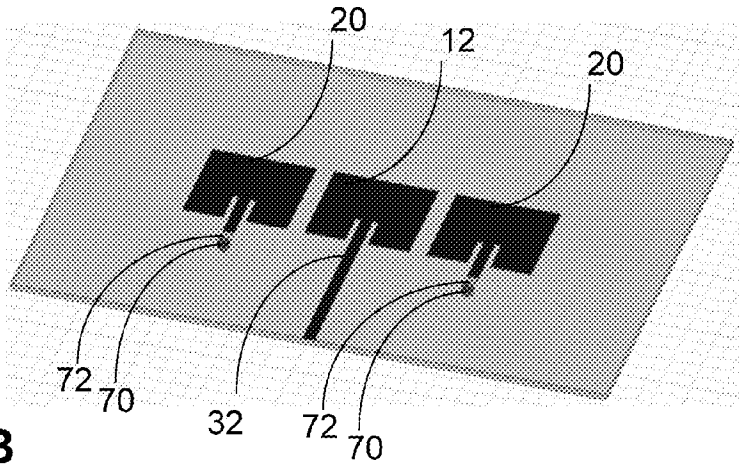
FIG. 7B shows an electro-magnetic (EM) simulation model of a single patch with two parasitically coupled elements reactively loaded in accordance with the present disclosure.

Those familiar with the art of phased arrays know that a phased array system can be treated as a multiport antenna system, as shown in FIG. 7A, which shows a network representation of a phased array antenna system with two ports 60 and 62. The coupling lines 16 can be represented in terms of equivalent circuits. Lumped element models can be derived to calculate the coupling coefficients and coupling pattern of the array and the parameters can be varied with the scan angle and frequency. Parasitic patches 20 themselves can be represented as resonant circuits with mainly capacitive coupling between them to change the radiation characteristics.

FIG. 7B is an electro-magnetic (EM) simulation model of a single driven patch 12 with two parasitic patches 20 reactively loaded with reactive loads 70. The reactive loads may be switched in or out, or the reactive loads changed by controlling switches 72, which may be PCM material. The resonant antenna elements can also be represented by a parallel resistor, inductor, capacitor (RLC) circuit with reactive loading. The matching network may be required for wide scans and is an effective way to compensate for the variation of the element impedance with scan angle.

Figure 8:
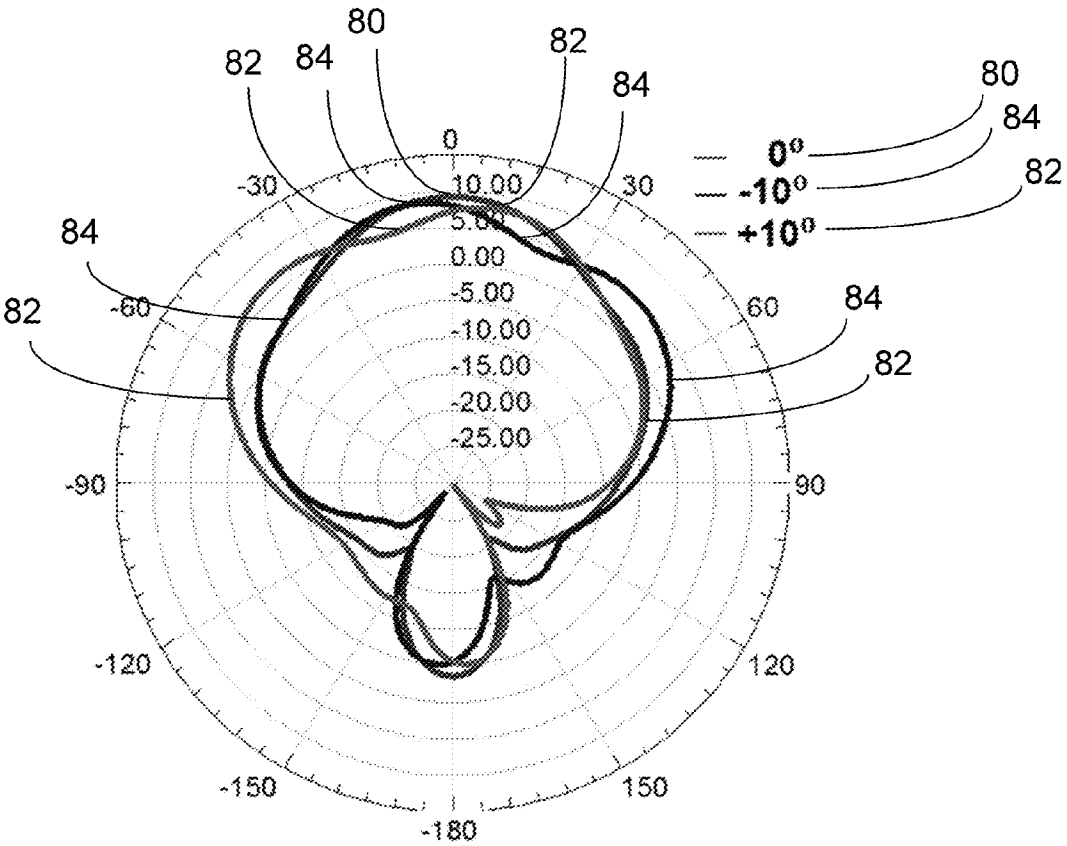
FIG. 8 shows an example of beam scanning with reactive loads on the parasitic elements in accordance with the present disclosure.

FIG. 8 is a simulation example showing beam scanning at 0 degrees 80, +10 degrees 82, and −10 degrees 84 with reactive loads on the parasitic elements that can be used for developing the equivalent circuit models for the reconfigurable array.

Figure 9:
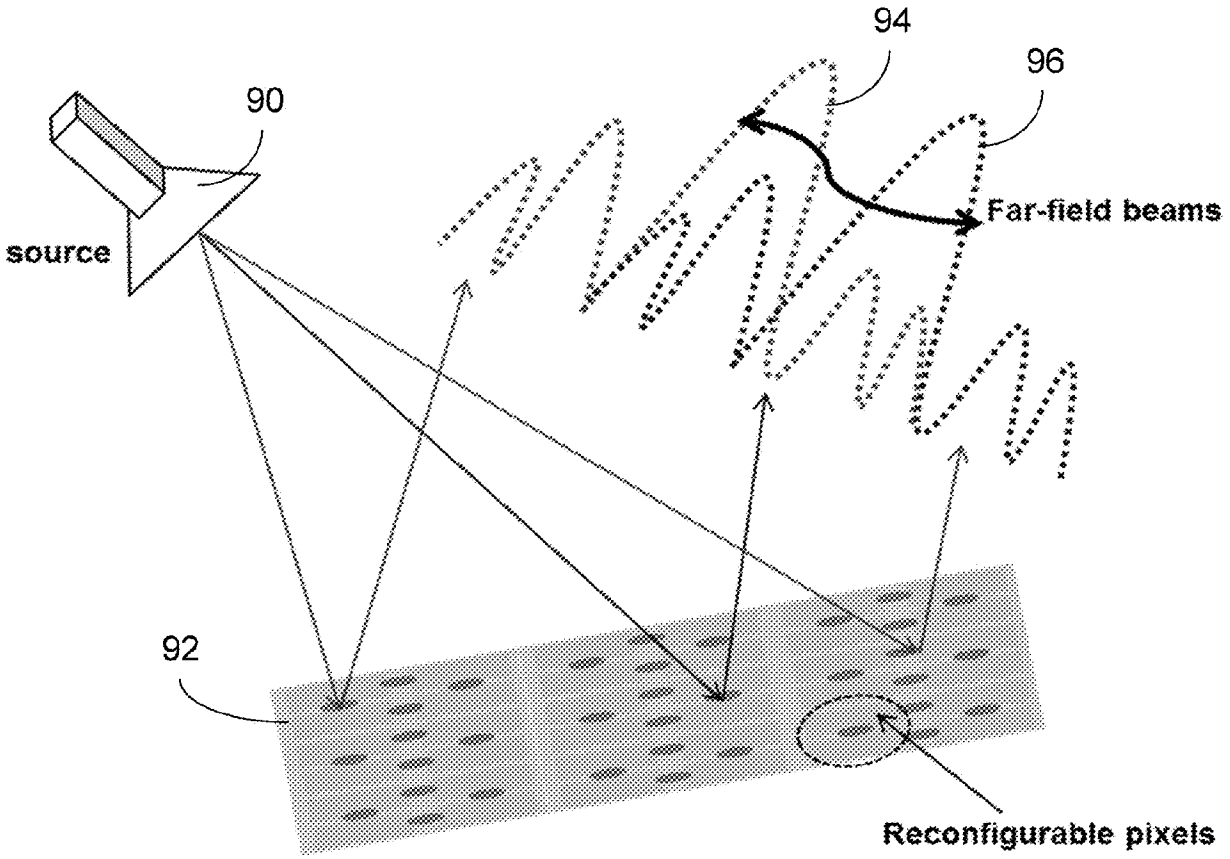
FIG. 9 shows an example of beams formed by reconfiguring parasitic elements and coupling elements in accordance with the present disclosure.

FIG. 9 shows another embodiment of the present disclosure. In this embodiment a source 90 radiates to the RF aperture 92, which produces a radiated beam pattern with far field beams, such as far field beam patterns 94 and 96. The far field beam patterns 94 and 96 vary depending on how the RF aperture 92 has been configured by switching PCM switches 14 and 18 either ON or OFF to reconfigure driven patches 12, parasitic patches 20, and reconfigurable coupling lines 16 as discussed above.

The embodiments of the present disclosure have the following advantages. The TR module count in phased arrays may be reduced without the disadvantage of prior art methods that use sub-arraying or sparse arrays, which cannot achieve wide angle scans and low-VSWR. The antenna characteristics may be changed using the reconfigurable parasitic elements. Controlled coupling with the reconfigurable coupling lines allows grating lobe free beam scans using an array spacing of greater than λ/2 at the design frequency. Also, reconfiguration occurs only on one surface of the RF aperture, which avoids the complication of reconfigurable RF feed lines.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A reconfigurable radio frequency aperture comprising:

a substrate;

a plurality of reconfigurable antenna patches on the substrate;

a plurality of radio frequency (RF) feed lines on the substrate, wherein a each respective RF feed line is connected to at least one respective reconfigurable antenna patch at a first location on the respective reconfigurable antenna patch; and a plurality of reconfigurable coupling elements on the substrate, the reconfigurable coupling elements comprising switches;

wherein at least one reconfigurable coupling element is coupled between a first reconfigurable antenna patch and a second reconfigurable antenna patch;

wherein at least one reconfigurable coupling element is coupled to the first reconfigurable antenna patch at a second location on the first reconfigurable antenna patch;

wherein at least one reconfigurable coupling element is coupled to the second reconfigurable antenna patch at a third location on the second reconfigurable antenna patch;

wherein the first location is different than the second location and is different than the third location; and wherein the reconfigurable coupling elements affect the mutual coupling between reconfigurable antenna patches.

2. The reconfigurable radio frequency aperture of claim 1 wherein the reconfigurable antenna patches each comprise:

first metal areas; and a plurality of first phase change material (PCM) switches, each first PCM switches between respective first metal areas;

wherein a size of a reconfigurable antenna patch may be changed by putting one or more of the first PCM switches in a conducting or a non-conducting state.

3. The reconfigurable radio frequency aperture of claim 2 wherein the first metal areas have dimensions that are less than half a wavelength of a desired center frequency of operation.

4. The reconfigurable radio frequency aperture of claim 2 wherein the first PCM switches have an insertion loss of about 0.1 dB, an on-state resistance ($R_{on}$) of less than 0.5 ohms, and an $R_{off}/R_{on}$ ratio of greater than or equal to $10^4$.

5. The reconfigurable radio frequency aperture of claim 1 wherein the reconfigurable coupling elements each comprise:

a plurality of coupling lines; and a plurality of second phase change material (PCM) switches, each second PCM switch between respective coupling lines;

wherein a configuration of a reconfigurable coupling element may be changed by putting the second PCM switches in a conducting or a non-conducting state.

6. The reconfigurable radio frequency aperture of claim 5 wherein at least one reconfigurable coupling element is arranged by one or more second PCM switches to be in a serpentine pattern.

7. The reconfigurable radio frequency aperture of claim 1 further comprising:

a plurality of reconfigurable parasitic elements on the substrate;

wherein at least one reconfigurable parasitic element is coupled between a reconfigurable antenna patch and another reconfigurable antenna patch;

wherein at least one reconfigurable coupling element is coupled between a reconfigurable antenna patch and a reconfigurable parasitic element, or between one reconfigurable parasitic element and another reconfigurable parasitic element; and wherein the reconfigurable coupling elements and the reconfigurable parasitic elements affect the mutual coupling between reconfigurable antenna patches.

8. The reconfigurable radio frequency aperture of claim 7 wherein the reconfigurable parasitic elements each comprise:

second metal areas; and a plurality of third phase change material (PCM) switches, each third PCM switch between respective second metal areas;

wherein a size and a shape of a reconfigurable parasitic element may be changed by putting the third PCM switches in a conducting or a non-conducting state.

9. The reconfigurable radio frequency aperture of claim 8 wherein at least one of the parasitic elements further comprises:

a fourth phase change material switch; and a reactive element;

wherein the fourth phase change material switch is coupled between a second metal area and the reactive element.

10. The reconfigurable radio frequency aperture of claim 7 wherein a mutual coupling between the plurality of reconfigurable antenna patches is controlled by configuring the plurality of reconfigurable parasitic elements and the plurality of reconfigurable coupling elements to suppress grating lobes and to maintain a low constant voltage standing wave ratio (VSWR) over a scan angle.

11. The reconfigurable radio frequency aperture of claim 1 wherein each respective RF feed line is connected to only one respective reconfigurable antenna patch.

12. The reconfigurable radio frequency aperture of claim 1 wherein a spacing between adjacent reconfigurable antenna patches is greater than half a wavelength of a desired center frequency of operation, or equal to a wavelength of a desired center frequency of operation.

13. The reconfigurable radio frequency aperture of claim 1 wherein the plurality of reconfigurable antenna patches are arranged on the substrate in a two dimensional array.

14. A reconfigurable radio frequency aperture comprising:

a substrate;

a plurality of reconfigurable antenna patches on the substrate;

a plurality of radio frequency (RF) feed lines on the substrate, wherein each respective RF feed line is connected to at least one respective reconfigurable antenna patch at a first location on the respective reconfigurable antenna patch; and a plurality of reconfigurable parasitic elements on the substrate;

wherein at least one reconfigurable parasitic element is between one reconfigurable antenna patch and another reconfigurable antenna patch;

a plurality of reconfigurable coupling elements on the substrate, the reconfigurable coupling elements comprising switches;

wherein at least one reconfigurable coupling element is coupled between a first reconfigurable antenna patch and a second reconfigurable parasitic element;

wherein at least one reconfigurable coupling element is coupled to the first reconfigurable antenna patch at a second location on the first reconfigurable antenna patch;

wherein at least one reconfigurable coupling element is coupled to the second reconfigurable antenna patch at a third location on the second reconfigurable antenna patch;

wherein the first location is different than the second location and is different than the third location; and wherein the reconfigurable parasitic elements affect the mutual coupling between reconfigurable antenna patches.

15. The reconfigurable radio frequency aperture of claim 14 wherein the reconfigurable antenna patches each comprise:

first metal areas; and a plurality of first phase change material (PCM) switches, each first PCM switches between respective first metal areas;

wherein a size of a reconfigurable antenna patch may be changed by putting one or more of the first PCM switches in a conducting or a non-conducting state.

16. The reconfigurable radio frequency aperture of claim 15 wherein the first metal areas have dimensions that are less than half a wavelength of a desired center frequency of operation.

17. The reconfigurable radio frequency aperture of claim 15 wherein the first PCM switches have an insertion loss of about 0.1 dB, an on-state resistance ($R_{on}$) of less than 0.5 ohms, and an $R_{off}/R_{on}$ ratio of greater than or equal to $10^4$.

18. The reconfigurable radio frequency aperture of claim 14 wherein the reconfigurable parasitic elements each comprise:

second metal areas; and a plurality of second phase change material (PCM) switches, each second PCM switch between respective second metal areas;

wherein a size and a shape of a reconfigurable parasitic element may be changed by putting the second PCM switches in a conducting or a non-conducting state.

19. The reconfigurable radio frequency aperture of claim 18 wherein at least one of the parasitic elements further comprises:

a fourth phase change material switch; and a reactive element;

wherein the fourth phase change material switch is coupled between a second metal area and the reactive element.

20. The reconfigurable radio frequency aperture of claim 14:

wherein at least one reconfigurable coupling element is coupled between a reconfigurable antenna patch and a reconfigurable parasitic element, between one reconfigurable parasitic element and another reconfigurable parasitic element, or between a reconfigurable antenna patch and another reconfigurable antenna patch; and wherein the reconfigurable coupling elements affect the mutual coupling between reconfigurable antenna patches.

21. The reconfigurable radio frequency aperture of claim 14 wherein the reconfigurable coupling elements each comprise:

a plurality of coupling lines; and a plurality of third phase change material (PCM) switches, each third PCM switch between respective coupling lines;

wherein a configuration of a reconfigurable coupling element may be changed by putting the third PCM switches in a conducting or a non-conducting state.

22. The reconfigurable radio frequency aperture of claim 21 wherein at least one reconfigurable coupling element is arranged by one or more third PCM switches to be in a serpentine pattern.

23. The reconfigurable radio frequency aperture of claim 14 wherein each respective RF feed line is connected to only one respective reconfigurable antenna patch.

24. The reconfigurable radio frequency aperture of claim 14 wherein a spacing between adjacent reconfigurable antenna patches is greater than half a wavelength of a desired center frequency of operation, or equal to a wavelength of a desired center frequency of operation.

25. The reconfigurable radio frequency aperture of claim 14 wherein the plurality of reconfigurable antenna patches are arranged on the substrate in a two dimensional array.

26. The reconfigurable radio frequency aperture of claim 14 wherein a mutual coupling between the plurality of reconfigurable antenna patches is controlled by configuring the plurality of reconfigurable parasitic elements and the plurality of reconfigurable coupling elements to suppress grating lobes and to maintain a low constant voltage standing wave ratio (VSWR) over a scan angle.

* * * * *